US005562240A

United States Patent [19]

Campbell

[11] Patent Number: 5,562,240

[45] Date of Patent: Oct. 8, 1996

[54] PROXIMITY SENSOR CONTROLLER MECHANISM FOR USE WITH A NAIL GUN OR THE LIKE

[76] Inventor: Brian R. Campbell, 3345 Rolston Cres., Victoria, BC, Canada, V8Z 4N9

[21] Appl. No.: 380,705

[22] Filed: Jan. 30, 1995

[51] Int. Cl.[6] ..... B25C 1/04; B25C 5/13; B25C 7/00

[52] U.S. Cl. ..... 227/130; 227/5; 173/20

[58] Field of Search ..... 227/5, 6, 7, 8, 227/107, 110, 130, 2; 30/371; 173/20

[56] References Cited

U.S. PATENT DOCUMENTS

| | | | |
|---|---|---|---|
| 2,558,181 | 6/1951 | Kassel | 62/91 |
| 2,684,787 | 7/1954 | Charpiat | 222/175 |
| 4,099,118 | 7/1978 | Franklin et al. | 324/61 R |
| 4,310,797 | 1/1982 | Butler | 324/228 |
| 4,464,622 | 8/1984 | Franklin | 324/67 X |
| 4,483,474 | 11/1984 | Nickolich | 227/8 |
| 5,238,167 | 8/1993 | Howard et al. | 227/110 |
| 5,352,974 | 10/1994 | Heger | 324/67 |
| 5,406,441 | 4/1995 | Warda et al. | 227/7 X |
| 5,421,230 | 6/1995 | Flaherty et al. | 30/371 X |

*Primary Examiner*—Scott A. Smith
*Assistant Examiner*—Jay A. Stelacone

[57] ABSTRACT

A proximity sensor controller mechanism for use with a nail gun or the like having a firing end. The proximity sensor controller mechanism includes an electrically-energizable proximity sensor circuit having a proximity sensor positionable near a firing end of a staple gun or a nail gun and with the energized proximity sensor transmitting a proximity signal when a recipient external object is placed in juxtaposition with a firing end of a nail gun or a staple gun. The proximity sensor circuit further has an indicator lamp coupled to the proximity sensor and with the indicator lamp being illuminated upon receipt of the proximity signal from the proximity sensor; a power source for supplying electrical energy to the proximity sensor circuit for operation; and a coupling mechanism for coupling the proximity sensor circuit to a nail gun or the like.

1 Claim, 3 Drawing Sheets

PROXIMITY SENSOR CONTROLLER MECHANISM FOR USE WITH A NAIL GUN OR THE LIKE

BACKGROUND OF THE INVENTION

1. Field of the Invention

The present invention relates to a proximity sensor controller mechanism for use with a nail gun or the like and more particularly pertains to controlling insertion of nails or similar projectiles into a recipient object with a proximity sensor controller mechanism for use with a nail gun or the like.

2. Description of the Prior Art

The use of nail guns is known in the prior art. More specifically, nail guns heretofore devised and utilized for the purpose of inserting nails into a recipient object are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,845,384 to Stoutenberg et al. discloses a stud finder. U.S. Pat. No. 4,310,797 to Butler discloses a stud detector using a magnetically actuated switch with magnetic biasing. U.S. Pat. No. 4,700,489 to Basile discloses a square-level measuring tool. U.S. Pat. No. 4,896,131 to Podlesny et al. discloses a stud finder with 1-piece magnet assembly. U.S. Pat. No. 5,110,027 to Burlingame discloses an attachment for hand-held nail guns. U.S. Pat. No. 5,148,108 to Dufour discloses a stud finder with level indicator.

While these devices fulfill their respective, particular objective and requirements, the aforementioned patents do not describe a proximity sensor controller mechanism for use with a nail gun or the like that provides a visual indication that a recipient object has been placed under the firing end of a nail gun or the like for coupling. Furthermore, the aforementioned patents do not describe a portable air tank that may be used in conjunction with a nail gun or the like which allows the nail gun or the like to be transported and utilized in a convenient conveyable-type configuration.

In this respect, the proximity sensor controller mechanism for use with a nail gun or the like according to the present invention substantially departs from the conventional concepts and designs of the prior art, and in doing so provides an apparatus primarily developed for the purpose of controlling insertion of nails or similar projectiles into a recipient object.

Therefore, it can be appreciated that there exists a continuing need for new and improved proximity sensor controller mechanism for use with a nail gun or the like which can be used for controlling insertion of nails or similar projectiles into a recipient object. In this regard, the present invention substantially fulfills this need.

SUMMARY OF THE INVENTION

In the view of the foregoing disadvantages inherent in the known types of nail guns now present in the prior art, the present invention provides an improved proximity sensor controller mechanism for use with a nail gun or the like. As such, the general purpose of the present invention, which will be described subsequently in greater detail, is to provide a new and improved proximity sensor controller mechanism for use with a nail gun or the like and method which has all the advantages of the prior art and none of the disadvantages.

To attain this, the present invention essentially comprises, in combination, a pneumatically-actuated nail gun. The nail gun is loadable with nails. The nail gun has a body with a firing end and a valve end. The valve end receives pressurized air for allowing nails to be propelled from the firing end.

A proximity sensor controller mechanism is provided. The proximity sensor controller mechanism includes a hollow rigid elongated sensor housing having an upper end, an open lower end, and a tapered intermediate portion therebetween. The sensor housing further has a generally rectangular cross section formed of a front wall, a rear wall, and opposed side walls. The sensor housing additionally has a rubber pad secured to the rear wall, a layer of adhesive applied to the rubber pad, and a paper-backing covering the adhesive and with the backing removed for adhering the sensor housing to the nail gun. The proximity sensor controller mechanism includes a pair of clamps with each clamp secured about the sensor housing and the nail gun and with the clamps holding the lower end of the sensor housing in proximity with the firing end of the nail gun. The proximity sensor controller mechanism includes an electrically-energizable proximity sensor disposed within the sensor housing near the lower end thereof and with the energized proximity sensor transmitting a proximity signal when a recipient external object is placed in juxtaposition with the firing end of the nail gun. The proximity sensor controller mechanism includes a power source removably disposed within the sensor housing for supplying electrical energy for operation.

A power switch mechanism is also provided. The power switch mechanism includes a hollow rigid box-shaped switch housing. The power switch mechanism has a power switch extended from the switch housing and removably coupled between the power source and proximity sensor of the sensor controller. The power switch has one orientation for allowing electrical energy to be transmitted to the proximity sensor and another orientation for preventing such transmission. The power switch mechanism further includes an electrical connector having a terminal end and a jack end extended from the switch housing and with the terminal end removably coupled to the proximity sensor.

A sheathed electrical cable is included. The cable has a terminal end and a plug end. The plug end of the cable is removably coupled to the jack of the power switch mechanism. An indicator lamp is included and coupled to the terminal end of the electrical cable. The indicator lamp is illuminated upon receipt of the proximity signal transmitted from the proximity sensor. The indicator lamp includes a bulb coupled to a base. The base has a conical shape with a flat lower surface, a layer of adhesive applied to the surface, and a peel-off backing covering the adhesive. The backing is removed for adhering the indicator lamp to a nail gun.

A tank is included and has a rigid bottle-like reservoir containing air pressurizable up to about 5,000 psi therein. A regulator valve is included and threadedly coupled to and in communication with the reservoir for reducing air pressure within the tank to between about 80 to 90 psi for use. An air hose is included and has a proximal end coupled to the regulator and a distal end coupled to the valve end of the nail gun for delivering pressurized air thereto.

Lastly, a generally tubular fabric carrying case is provided. The carrying case has a flat sealed bottom end, an open conical top end, and a zipper sewn to the case between the top and bottom ends. The zipper is openable for allowing the tank to be deposited therein and closeable for sealing the tank therein. The carrying case further includes a first strap and a second strap. The first strap has one end sewn to the case and another end having a securement mechanism formed thereon. The second strap has one end sewn to the case and another end with a securable mechanism formed thereon. The securement mechanism of the first strap is removably couplable with the securable mechanism of the second strap for placing the straps in a closed loop configuration for carrying about a shoulder or a waist of a user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved proximity sensor controller mechanism for use with a nail gun or the like which has all the advantages of the prior art nail guns and none of the disadvantages.

It is another object of the present invention to provide a new and improved proximity sensor controller mechanism for use with a nail gun or the like which may be easily and efficiently manufactured and marketed.

It is a further object of the present invention to provide a new and improved proximity sensor controller mechanism for use with a nail gun or the like which is of durable and reliable construction.

An even further object of the present invention is to provide a new and improved proximity sensor controller mechanism for use with a nail gun or the like which is susceptible of a low cost of manufacture with regard to both materials and labor, and which accordingly is then susceptible of low prices of sale to the consuming public, thereby making such a proximity sensor controller mechanism for use with a nail gun or the like economically available to the buying public.

Still yet another object of the present invention is to provide a new and improved proximity sensor controller mechanism for use with a nail gun or the like which provides in the apparatuses and methods of the prior art some of the advantages thereof, while simultaneously overcoming some of the disadvantages normally associated therewith.

Even still another object of the present invention is to provide a new and improved proximity sensor controller mechanism for use with a nail gun or the like for controlling insertion of nails or similar projectiles into a recipient object.

Lastly, it is an object of the present invention to provide a new and improved proximity sensor controller mechanism for use with a nail gun or staple gun having a firing end, the proximity sensor controller mechanism comprising an electrically energizable proximity sensor circuit including a proximity sensor positionable near a firing end of a staple gun or a nail gun and with the energized proximity sensor transmitting a proximity signal when a recipient external object is placed in juxtaposition with a firing end of a nail gun or a staple gun, the proximity sensor circuit further including an indicator lamp coupled to the proximity sensor and with the indicator lamp being illuminated upon receipt of the proximity signal from the proximity sensor; a power source for supplying electrical energy to the proximity sensor circuit for operation; and coupling means for coupling the proximity sensor circuit to a nail gun or a staple gun.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
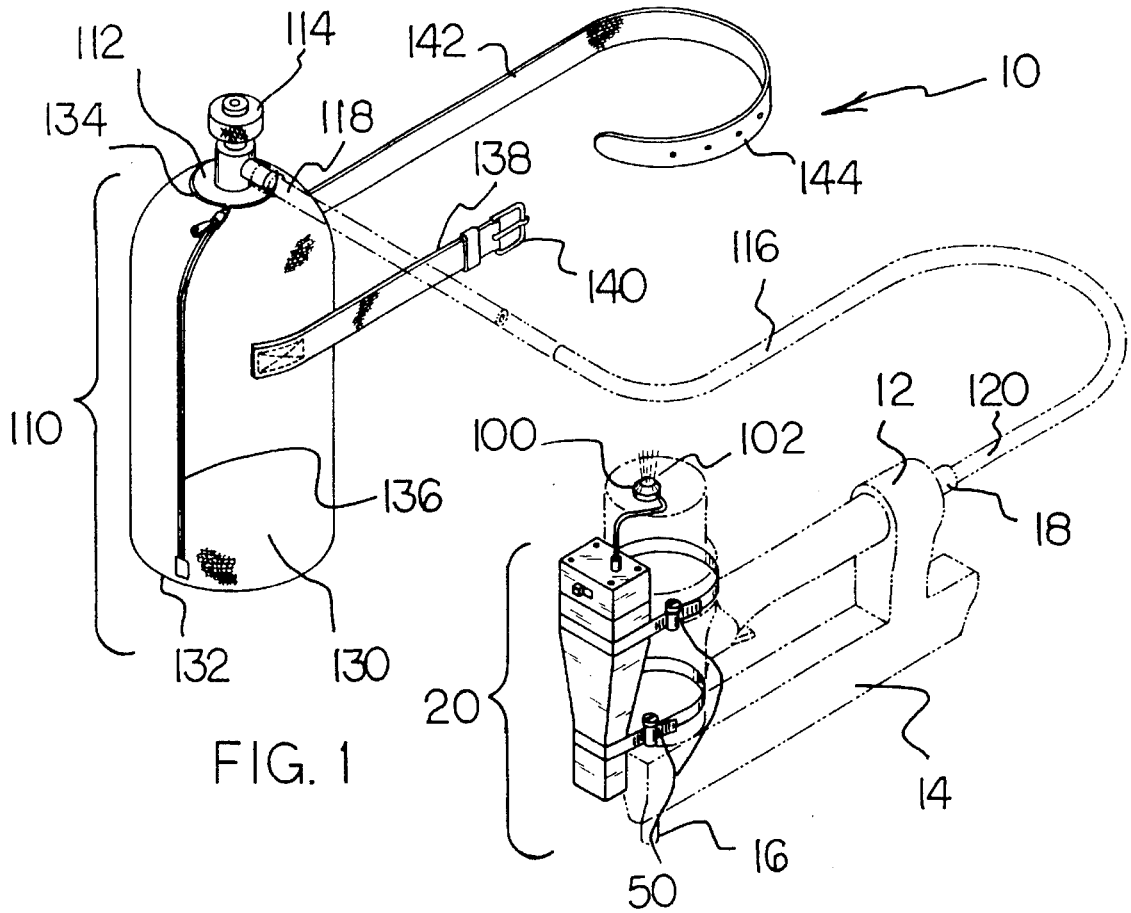
FIG. 1 is a perspective view of the preferred embodiment constructed in accordance with the principles of the present invention.
Figure 2:
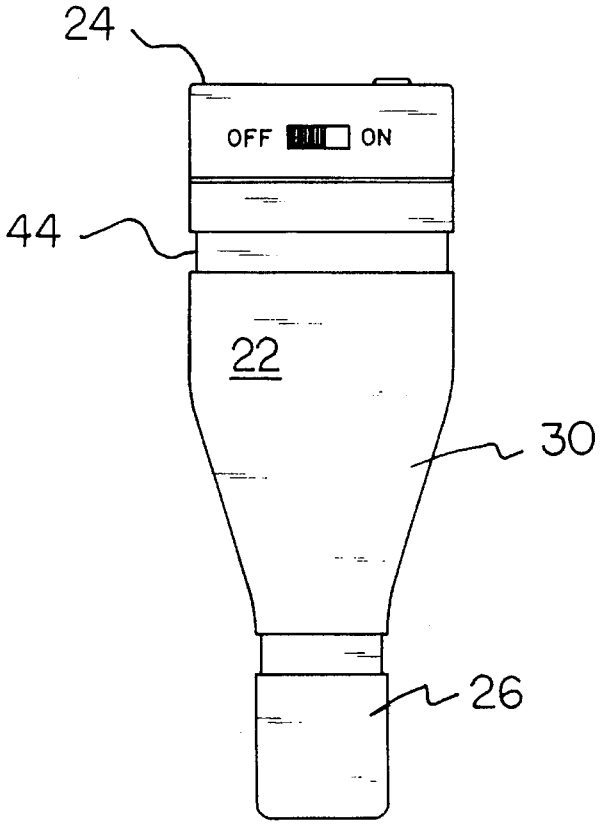
FIG. 2 is a front view of the controller of the present invention.
Figure 3:
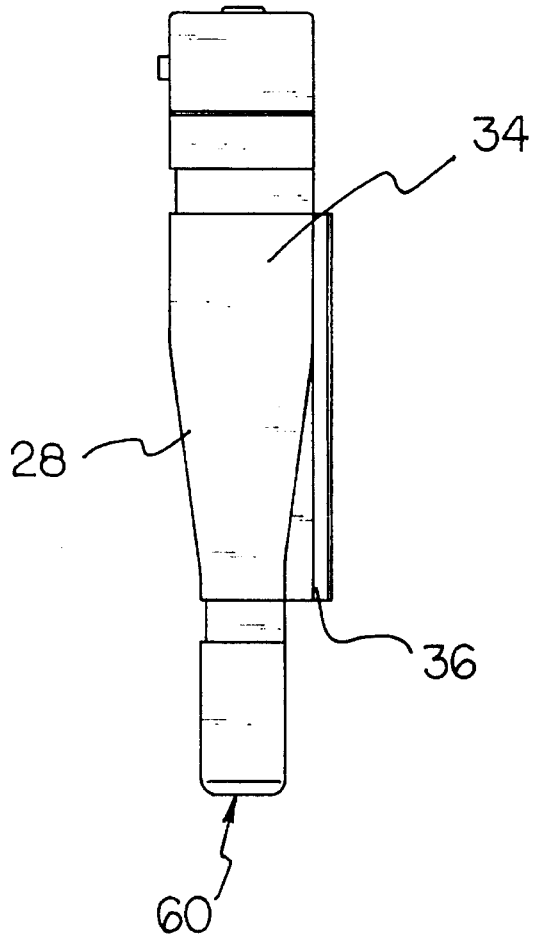
FIG. 3 is a side-elevational view of the controller of the present invention.
Figure 4:
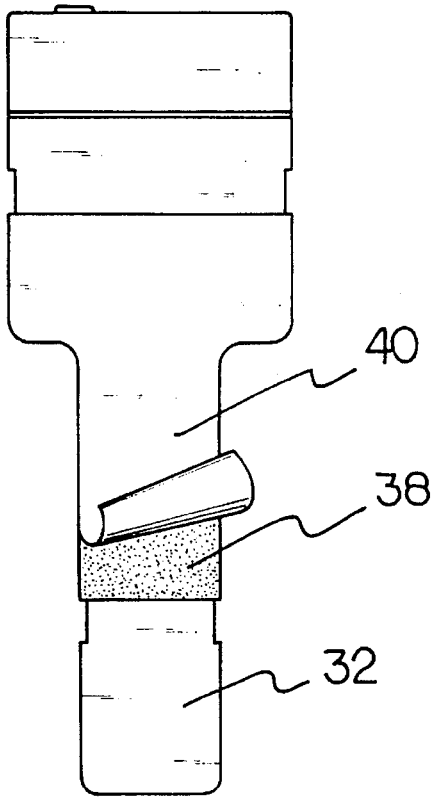
FIG. 4 is a rear view of the controller of the present invention.

With reference now to the drawings, and in particular, to FIG. 1 thereof, the preferred embodiment of the new and improved proximity sensor controller mechanism for use with a nail gun or the like embodying the principles and concepts of the present invention and generally designated by the reference number 10 will be described.

The present invention is comprised of a plurality of components. In their broadest context, such components include a nail gun, a proximity sensor controller mechanism, a power switch mechanism, indicator lamp, and air tank. Such components are individually configured and correlated with respect to each other to provide a visual indication of when a nail gun should be actuated for performing coupling operations and also allow a nail gun to be transported in a convenient configuration for use free from connection with stationary immovable air supply mechanisms.

Specifically, the present invention includes a nail gun 12. The nail gun is loadable with nails and is pneumatically-actuated. The nail gun has a body 14 with a firing end 16 and a valve end 18. The valve end is used for receiving pressurized air for allowing nails to be propelled from the firing end. The nail gun is conventional in design and commercially available. Similarly, a staple gun or similar type coupling apparatus may also be utilized.

In addition, a sensor controller mechanism 20 is provided. The sensor controller mechanism includes a sensor housing 22. The sensor housing is hollow and elongated in structure. The sensor housing is formed of a rigid material such as metal or plastic. The sensor housing has a large upper end 24, a small lower end 26, and an intermediate tapered portion 28 therebetween. The sensor housing has a generally rectangular vertical cross section. The upper end of the sensor has threaded bores 29 formed thereon. Furthermore, the sensor housing includes a front wall 30, a rear wall 32, and opposed side walls 34. A rubber pad 36 is secured to the rear wall. A layer of adhesive 38 is applied to the rubber pad. Lastly, a paper backing 40 is disposed over the adhesive. The backing is removed for adhering the sensor housing 22 to the nail gun 12. In addition, the upper end 24 of the sensor housing has a battery compartment 42 formed thereon. The intermediate portion 28 of the sensor housing also includes a pair of spaced grooves 44 formed thereon.

A pair of clamps 50 are provided as shown in FIG. 1. Each clamp is secured about the sensor housing 22 within a separate groove and about the nail gun 12 to ensure a tight fit as shown in FIG. 1. The clamps hold the lower end 26 of the sensor housing in proximity with the firing end 16 of the nail gun. Conventional clamping means such as hose clamps can be utilized.

The sensor controller mechanism 20 also includes an electrically-energizable proximity sensor 60. The proximity sensor is disposed within the sensor housing 22 near the open lower end 26 thereof. The energized proximity sensor transmits a proximity signal when a recipient external object such as a board or stud is placed in juxtaposition with the firing end 16 of the nail gun. The proximity sensor is conventional in design and commercially available.

Figure 6:
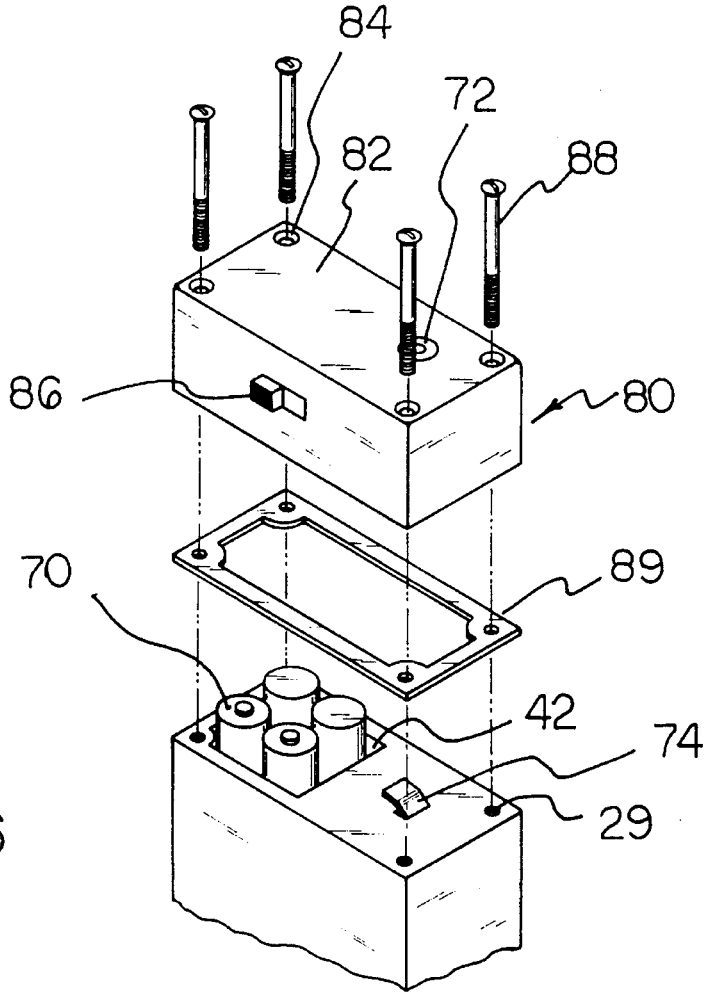
FIG. 6 is an exploded perspective view of the controller and switch mechanism of the present invention.

Also provided as part of the sensor controller mechanism 20 is a power source 70 as shown in FIG. 6. The power source is comprised of four replaceable and commercially available batteries. The batteries are removably disposed within the battery compartment 42 of the sensor housing 22. The power source supplies electrical energy to the present invention for operation.

As shown in FIG. 6, a power switch mechanism 80 is included. The power switch mechanism has a hollow box-shaped switch housing 82 with threaded bores 84 disposed therethrough. The switch housing is formed of a rigid material such as metal or plastic. The power switch mechanism also includes a power switch 86. The power switch is extended from the switch housing 82 and is removably coupled between the power source 70 and proximity sensor 60 of the sensor controller 20. The power switch has one orientation for allowing electrical energy to be transmitted to the proximity sensor and another orientation for preventing such transmission. The power switch mechanism also includes an electrical connector having a terminal end and a jack end 72 extended from the switch housing 82. The terminal end of the electrical connector is removably coupled to the proximity sensor through lead 74 as shown in FIG. 6. The power switch mechanism is removably coupled to the sensor housing 22 through the use of rigid threaded fasteners 88. In addition, a rubber gasket 89 is disposed between the housings to ensure a tight fit and preclude the associated electrical connections from shorting or corroding.

Figure 5:
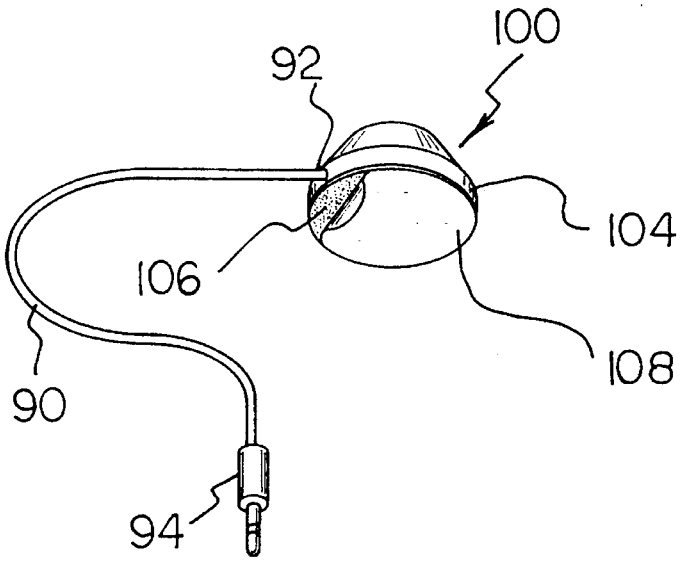
FIG. 5 is a perspective view of the indicator lamp and power cable of the present invention.

As shown in FIG. 5, an electrical cable 90 is provided. The electrical cable is formed of a conductive metal sheathed with a non-conductive plastic. The electrical cable has a terminal end 92 and a plug end 94. The plug end is removably coupled to the jack 72 of the power switch mechanism 80.

Also shown in FIG. 5 is an indicator lamp 100. The indicator lamp is coupled to the terminal end 92 of the electrical cable. The indicator lamp is illuminated upon receipt of the proximity signal transmitted from the proximity sensor 60. The indicator lamp includes a bulb 102 coupled to a rigid plastic base 104. The base has a conical shape with a flat lower surface. In addition, a layer of adhesive 106 is applied to the lower surface of the base. A removable peel-off backing 108 covers the adhesive. The backing is removed for adhering the indicator lamp to a nail gun 12 for viewing as shown in FIG. 1.

To provide pressurized air for actuating a nail gun, an air tank 110 is included. The tank has a rigid bottle-like reservoir 112. The reservoir contains air pressurized up to about 5,000 psi. The tank also includes a regulator valve 114 threadedly coupled to and in communication with the reservoir. The regulator valve reduces air pressure within the reservoir to between about 80–90 psi for use. An air hose 116 is also provided. The air hose has a proximal end 118 coupled to the regulator and a distal end 120 coupled to the valve end of the nail gun. The air hose delivers pressurized air to the air gun.

Lastly, a carrying case 130 is provided for carrying the tank in a portable type configuration. The carrying case is tubular in structure and formed of fabric or similar flexible material. The carrying case has a flat circular planar sealed bottom end 132, and an open conical top end 134. A zipper 136 is sewn to the case between the top and bottom ends. The zipper is openable for allowing the tank to be deposited therein and closable for sealing the tank therein. The carrying case further includes a first strap 138 having one end sewn to the case and another end with a buckle 140 coupled thereto. A second strap 142 is included and has one end sewn to the case and another end with a plurality of holes 144 formed thereon. The buckle is adjustably and removably securable within the holes 144 on the second strap for placing the straps in a closed-loop configuration for carrying about a shoulder or waist of a user, Thus, the carrying case allows the tank to be readily carried from one location to another for actuating the nail gun. In summary, the present invention is a typical pneumatic air gun used in construction except that the air gun has a sensor coupled thereto to indicate that there is something beneath the firing end for coupling. It also utilizes a small pressure tank with a regulator so that an operator may carry the tank and nail gun in a portable-type operational mode.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A nail gun apparatus comprising, in combination:

a pneumatically-actuated nail gun loadable with nails, the nail gun having a body with a firing end and a valve end for receiving pressurized air for allowing nails to be propelled from the firing end;

a proximity sensor controller mechanism further comprising:

a hollow rigid elongated sensor housing having an upper end, an open lower end, and a tapered intermediate portion therebetween, the sensor housing further having generally rectangular cross section formed of a front wall, a rear wall, and opposed side walls, the sensor housing additionally having a rubber pad secured to the rear wall, a layer of adhesive applied to the rubber pad, and a paper-backing covering the adhesive and with the backing removed for adhering the sensor housing to the nail gun;

a pair of clamps with each clamp secured about the sensor housing and the nail gun and with the clamps holding the lower end of the sensor housing in proximity with the firing end of the nail gun;

an electrically-energizable proximity sensor disposed within the sensor housing near the lower end thereof and with the energized proximity sensor transmitting a proximity signal when a recipient external object is placed in juxtaposition with the firing end of the nail gun; and a power source removably disposed within the sensor housing for supplying electrical energy for operation;

a power switch mechanism including a hollow rigid box-shaped switch housing, a power switch extended from the switch housing and removably coupled between the power source and proximity sensor of the sensor controller and with the power switch having one orientation for allowing electrical energy to be transmitted to the proximity sensor and another orientation for preventing such transmission, the power switch mechanism further including an electrical connector having a terminal end and a jack end extended from the switch housing and with the terminal end removably coupled to the proximity sensor;

a sheathed electrical cable having a terminal end and a plug end and with the plug end removably coupled to the jack of the power switch mechanism;

an indicator lamp coupled to the terminal end of the electrical cable and with the indicator lamp being illuminated upon receipt of the proximity signal transmitted from the proximity sensor, the indicator lamp including a bulb coupled to a base and with the base having a conical shape with a flat lower surface, a layer of adhesive applied to the surface, and a peel-off backing covering the adhesive and with the backing removed for adhering the indicator lamp to a nail gun;

a tank having a rigid bottle-like reservoir containing air pressurizable up to about 5,000 psi therein, a regulator valve threadedly coupled to and in communication with the reservoir for reducing air pressure within the tank to between about 80 to 90 psi for use, and an air hose having a proximal end coupled to the regulator and a distal end coupled to the valve end of the nail gun for delivering pressurized air thereto; and a generally tubular fabric carrying case having a flat sealed bottom end, an open conical top end, and a zipper sewn to the case between the top and bottom ends, the zipper openable for allowing the tank to be deposited therein and closeable for sealing the tank therein, the carrying case further including a first strap having one end sewn to the case and another end having a buckle formed thereon, a second strap having one end sewn to the case and another end with a plurality of holes formed thereon and with the buckle removably couplable with the plurality of holes for placing the straps in a closed loop configuration for carrying about a shoulder or a waist of a user.

* * * * *